US008096133B2

(12) United States Patent
Hessler et al.

(10) Patent No.: US 8,096,133 B2
(45) Date of Patent: Jan. 17, 2012

(54) METHOD AND APPARATUS FOR COOLING AND DILUTION TUNING A GAS TURBINE COMBUSTOR LINER AND TRANSITION PIECE INTERFACE

(75) Inventors: William K. Hessler, Greer, SC (US); Predrag Popovic, Greenville, SC (US); Charles Nyberg, Greenville, SC (US)

(73) Assignee: General Electric Company, Schenectady, NY (US)

( * ) Notice: Subject to any disclaimer, the term of this patent is extended or adjusted under 35 U.S.C. 154(b) by 764 days.

(21) Appl. No.: 12/153,020

(22) Filed: May 13, 2008

(65) Prior Publication Data

US 2009/0282833 A1 Nov. 19, 2009

(51) Int. Cl.
*F02C 1/00* (2006.01)
*F02G 3/00* (2006.01)

(52) U.S. Cl. ..... 60/752; 60/754

(58) Field of Classification Search ..... 60/752–760, 60/804, 39.37

See application file for complete search history.

(56) References Cited

U.S. PATENT DOCUMENTS 3,777,484 A * 12/1973 Dibelius et al. ..... 60/757
4,413,477 A * 11/1983 Dean et al. ..... 60/757
4,628,694 A * 12/1986 Kelm et al. ..... 60/752
4,719,748 A * 1/1988 Davis et al. ..... 60/39.37
4,872,312 A * 10/1989 Iizuka et al. ..... 60/760
4,903,477 A * 2/1990 Butt ..... 60/39.37
4,916,906 A * 4/1990 Vogt ..... 60/757
5,127,221 A * 7/1992 Beebe ..... 60/772
5,285,631 A * 2/1994 Bechtel et al. ..... 60/776
5,454,221 A * 10/1995 Loprinzo ..... 60/772
5,735,126 A * 4/1998 Schulte-Werning ..... 60/732
5,784,876 A * 7/1998 Alkabie ..... 60/776
6,098,397 A * 8/2000 Glezer et al. ..... 60/772
6,134,877 A * 10/2000 Alkabie ..... 60/800
6,334,310 B1 1/2002 Sutcu
6,427,446 B1 * 8/2002 Kraft et al. ..... 60/737
6,446,438 B1 * 9/2002 Kraft et al. ..... 60/737
6,484,505 B1 * 11/2002 Brown et al. ..... 60/760
6,494,044 B1 * 12/2002 Bland ..... 60/772
6,832,482 B2 * 12/2004 Martling et al. ..... 60/737
6,865,892 B2 * 3/2005 Garrido et al. ..... 60/798
6,928,822 B2 8/2005 Rock
6,935,116 B2 * 8/2005 Stuttaford et al. ..... 60/737
6,951,109 B2 * 10/2005 Lemon et al. ..... 60/760
6,968,693 B2 11/2005 Colibaba-Evulet
7,082,766 B1 8/2006 Widener
7,082,770 B2 * 8/2006 Martling et al. ..... 60/796
7,260,935 B2 8/2007 Colibaba-Evulet
7,284,378 B2 10/2007 Amond
7,299,618 B2 11/2007 Terazaki
7,389,643 B2 * 6/2008 Simons et al. ..... 60/772
7,493,767 B2 * 2/2009 Bunker et al. ..... 60/752
7,524,167 B2 * 4/2009 Ohri et al. ..... 415/215.1

(Continued)

*Primary Examiner* — William H Rodriguez
(74) *Attorney, Agent, or Firm* — Nixon & Vanderhye, P.C.

(57) ABSTRACT

A combustor liner includes a forward end and an aft end, the aft end having a reduced diameter portion and a cooling and dilution sleeve overlying the reduced diameter portion thereby establishing a cooling plenum therebetween. A plurality of cooling and dilution air entry holes are formed in the cooling and dilution sleeve and a plurality of cooling and dilution air exit holes formed adjacent an aft edge of the liner such that, in use, cooling and dilution air flows through the cooling and dilution air entry holes, and through the plenum, exiting the cooling and dilution air exit holes, thereby cooling and dilution tuning the aft end of the combustor liner without having to remove the transition piece.

18 Claims, 5 Drawing Sheets

U.S. PATENT DOCUMENTS

| | | | | |
|---|---|---|---|---|
| 7,631,504 | B2 * | 12/2009 | Belsom | 60/772 |
| 7,707,835 | B2 * | 5/2010 | Lipinski et al. | 60/752 |
| 7,707,836 | B1 * | 5/2010 | Barnes et al. | 60/755 |
| 7,712,314 | B1 * | 5/2010 | Barnes et al. | 60/755 |
| 2005/0132708 | A1 | 6/2005 | Martling | |
| 2005/0144953 | A1 * | 7/2005 | Martling et al. | 60/752 |
| 2006/0168967 | A1 * | 8/2006 | Simons et al. | 60/772 |
| 2008/0092547 | A1 * | 4/2008 | Lockyer et al. | 60/757 |
| 2010/0043441 | A1 * | 2/2010 | Hessler et al. | 60/752 |

* cited by examiner

METHOD AND APPARATUS FOR COOLING AND DILUTION TUNING A GAS TURBINE COMBUSTOR LINER AND TRANSITION PIECE INTERFACE

BACKGROUND OF THE INVENTION

This invention relates to internal cooling within a gas turbine engine, and more particularly, to an apparatus and a method for providing better and more uniform cooling in a transition or interface region between a combustor liner and a transition piece.

Traditional gas turbine combustors use diffusion (i.e., non-premixed) combustion in which fuel and air enter the combustion chamber separately. The process of mixing and burning produces flame temperatures exceeding 3900° F. Since conventional combustors and/or transition pieces are generally capable of withstanding a maximum temperature on the order of only about 1500° F. for about ten thousand hours (10,000 hrs.), steps to protect the combustor and/or transition piece must be taken. This has typically been done by film-cooling which involves introducing relatively cool compressor air into a plenum formed by an impingement cooling sleeve surrounding the transition piece and a flow sleeve surrounding the combustor liner. This cooling air is ultimately reverse-flowed into the combustor where it mixes with fuel for combustion and dilution tuning.

Various techniques have been employed to cool the aft end of the combustor liner (that end adjacent the transition piece) and the compression seal (or "hula" seal) typically used at the interface of the transition piece and combustor liner. See, for example, U.S. Pat. No. 6,098,397 which discloses providing an array of concavities on the outside surface of the liner to enhance heat transfer. Another technique is disclosed in U.S. Pat. No. 7,010,921 where the aft end of the combustor liner is provided with a plurality of axially extending ribs or turbulators about its circumference, covered with a sleeve or cover plate, thus forming a series of cooling channels. Cooling air is introduced into the channels through air inlet slots or openings at the forward end of the channels, and exits into the transition piece which is telescoped over the aft end of the liner.

Tuning of the combustor (including the cooling configuration), which can only be done after the turbine is operational, typically involves disassembly of the turbine and removal of the transition piece for drilling or welding dilution holes therein. This is a time-consuming and thus costly process.

There remains a need, therefore, for a cooling arrangement that provides effective, uniform cooling of the aft end of the combustor liner/transition piece interface, but that also simplifies the combustor tuning process.

BRIEF DESCRIPTION OF THE INVENTION

In one exemplary but nonlimiting aspect, the present invention relates to a combustor liner comprising a forward end and an aft end, the aft end having a reduced diameter portion and a cooling and dilution sleeve overlying the reduced diameter portion thereby establishing a cooling plenum therebetween; a plurality of cooling air entry holes formed in the cooling sleeve and a plurality of cooling air exit holes formed adjacent an aft edge of the liner such that, in use, cooling air flows through the cooling air entry holes and through the plenum, exiting the cooling air exit holes thereby cooling the aft end of the combustor liner, and affecting dilution tuning.

In another exemplary but nonlimiting aspect, the invention relates to a combustor liner comprising a liner forward end and a liner aft end, the liner aft end having a reduced diameter portion and a cooling sleeve overlying the reduced diameter portion thereby establishing a cooling plenum therebetween; a plurality of cooling air entry holes formed in the cooling sleeve and a plurality of cooling air exit holes formed adjacent an aft liner edge such that, in use, cooling air flows through the cooling air entry holes, and through the plenum, exiting the cooling air exit holes thereby cooling the aft liner end; wherein a compression seal is secured to an exterior surface of the cooling sleeve, directly radially outwardly of the plenum; and wherein the liner aft end includes an inwardly tapered portion leading to the reduced diameter portion, and an outwardly tapered portion leading to an annular collar, the cooling sleeve having a forward sleeve end engaged with the liner at a location upstream of the inwardly tapered portion, and an aft sleeve end fixed to the collar.

In still another exemplary but non limiting aspect, the invention relates to a method of cooling an aft end of a combustor liner and associated annular seal comprising:

forming an aft end portion of the liner with a reduced diameter portion;

locating a cooling sleeve about the reduced diameter portion, in radially spaced relationship thereto so as to create an annular plenum;

forming cooling air entry holes in an upstream end of the cooling sleeve and cooling air exit holes in the liner, proximate an aft edge thereof, such that, in use, cooling air flows through the cooling air entry holes into the plenum and through the cooling air exit holes.

The invention will now be described in detail in connection with the drawings identified below.

DETAILED DESCRIPTION OF THE DRAWINGS

Figure 1:
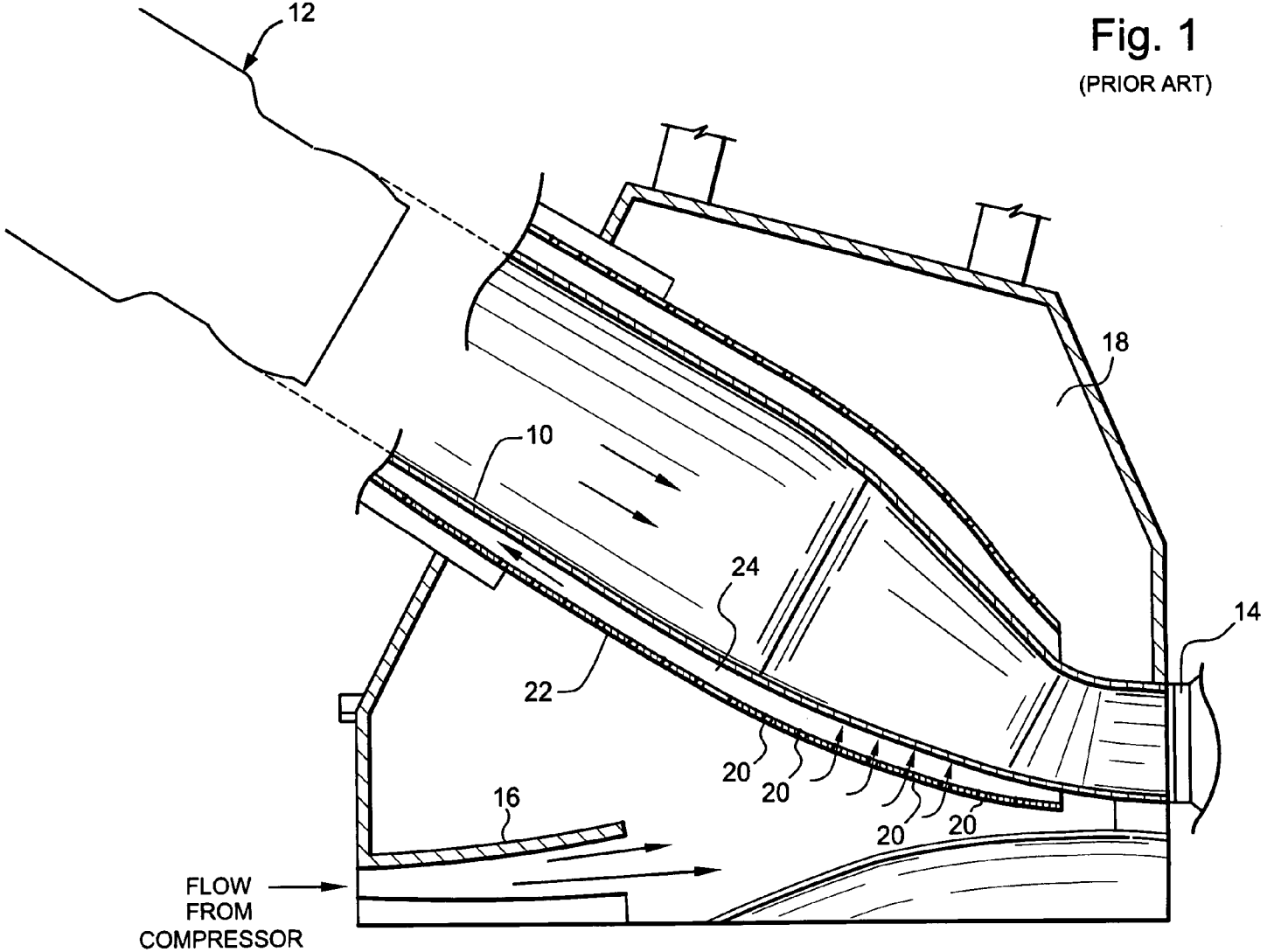
Fig. 1 (PRIOR ART)
FIG. 1 is a partial section illustrating a known gas turbine transition piece construction, with an associated combustor liner shown schematically.

With reference to FIG. 1, a typical gas turbine includes a transition piece 10 by which the hot combustion gases from an upstream combustor as represented by the schematically-illustrated combustor liner 12 are passed to the first stage of a turbine represented at 14. Flow from the gas turbine compressor exits an axial diffuser 16 and enters into a compressor discharge case 18. In some transition piece designs, about 50% of the compressor discharge air passes through apertures 20 formed along and about a transition piece impingement sleeve 22 for flow in an annular region or annulus 24 (or, second flow annulus) between the transition piece 10 and the radially outer transition piece impingement sleeve 22. The remaining approximately 50% of the compressor discharge flow passes into holes in an upstream combustion liner flow sleeve (not shown) and into an annulus between the flow sleeve and the liner 12 where it mixes with the air in annulus 24 before being reverse-flowed into the combustion chamber.

A known arrangement for coupling of the transition piece and impingement sleeve with the combustor liner and flow sleeve is disclosed in, for example, U.S. Pat. No. 7,010,921, and need not be described in further detail here.

Figure 2:
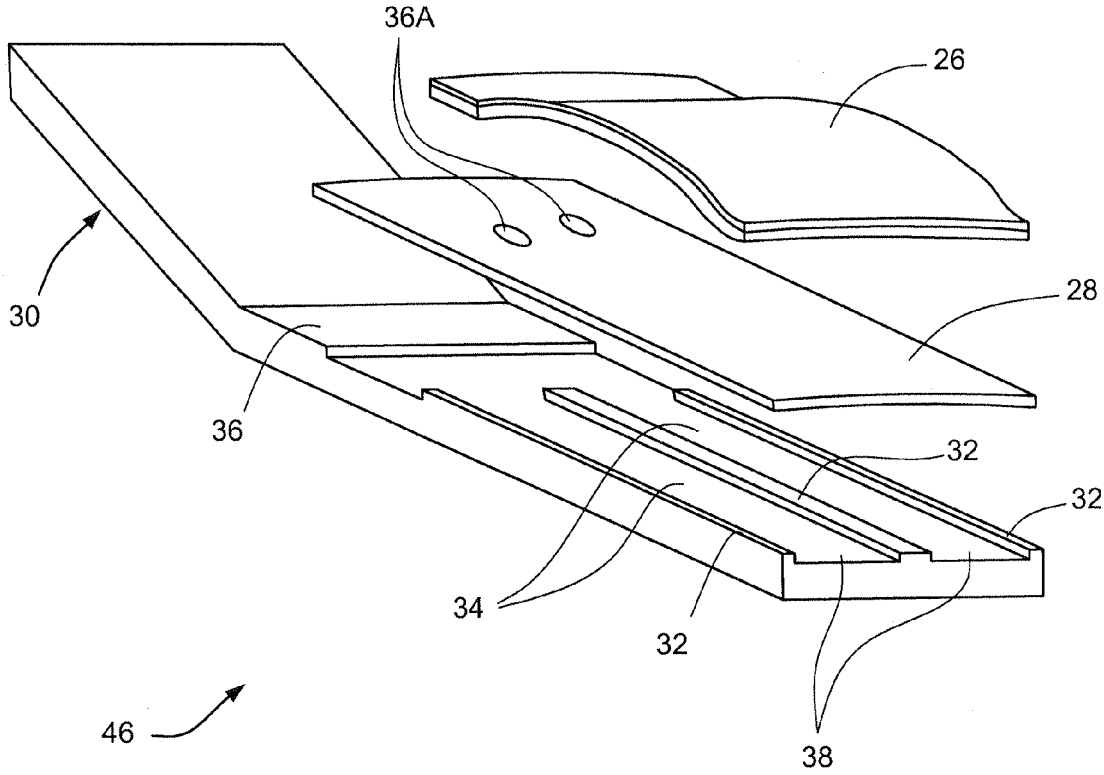
Fig. 2 (PRIOR ART)
FIG. 2 is an exploded partial perspective view of the aft end of a combustor liner in accordance with a known cooling configuration.

In FIG. 2, a current cooling configuration for the aft end of liner 12 (similar to the arrangement disclosed in U.S. Pat. No. 7,010,921) is shown to include an associated compression-type seal 26, commonly referred to as a "hula seal", mounted on the cover plate 28, adjacent a tapered transition region 30 of the liner. It will be appreciated that FIG. 2 shows only "slices" of the otherwise annular component parts. Thus, the cylindrical cover plate 28 is mounted on the liner to form a mounting surface for the annular compression seal 26 and to form a portion of the axial airflow channels 34. More specifically, liner 12 has a plurality of axial raised sections or ribs 32 which extend over a portion of aft end of the liner 12. The cover plate 28 and ribs 32 together define the respective airflow channels 34. These channels are substantially parallel and extend over a portion of aft end of liner 12. Cooling air is introduced into the channels 34 through an annular air inlet slot or opening 36 (or holes 36A) at the forward end of the channels. The cooling air flows into and through the channels 34 and exits through openings 38 at an aft end of the liner.

Figure 3:
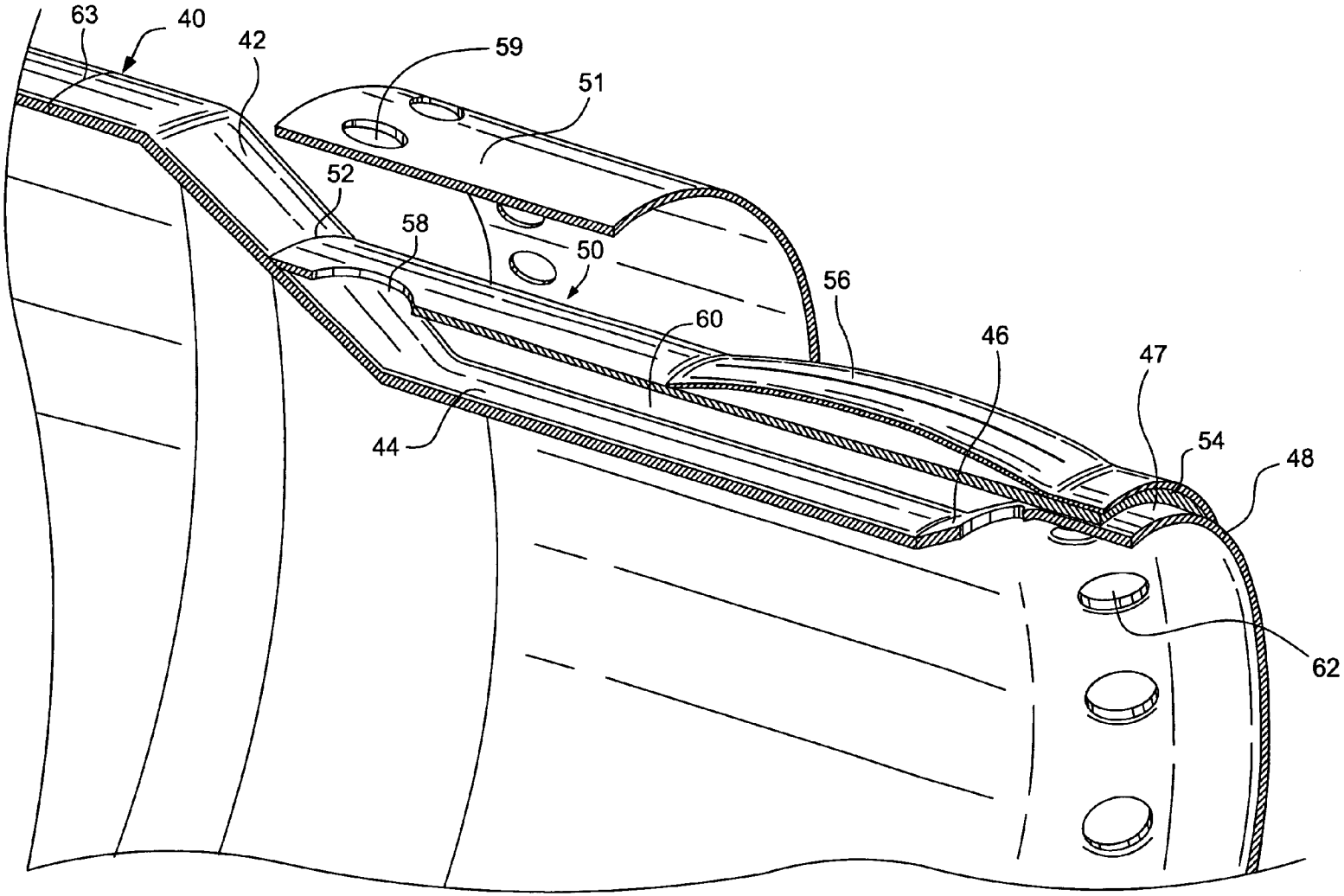
FIG. 3 is a partial section through the aft end of a combustor liner in accordance with a first exemplary but nonlimiting embodiment of the invention.

Turning now to FIG. 3, one exemplary but nonlimiting embodiment of the invention shows the aft end of the liner 40 formed with a radially inward taper 42, establishing a reduced diameter portion 44 at the downstream end of the liner: A radially outwardly tapered portion 46 expands the liner to a larger diameter, with an annular collar 47 terminating at an aft edge 48. A tubular, cylindrical cooling sleeve 50 extends from a point about midway along the tapered portion 42 of the liner, to an aft edge 54 adjacent the terminal edge 48 of the liner. The sleeve 50 may be welded to the collar portion 47 of the liner. A spring seal (or hula seal) 56 is secured to the aft edge of the cooling sleeve 50 (by, for example, welding) and enables sealing engagement with the interior surface of the transition piece (not shown).

Cooling air entry holes 58 are provided in an annular array about the cooling sleeve 50, at a location proximate the forward edge 52 of the sleeve. Thus, cooling air flowing through the air entry holes 58, enters a cooling plenum 60 between the reduced diameter portion 44 of the liner and the cooling sleeve 50. Air flowing through the plenum exits through an annular array of cooling air exit holes 62 formed in the outwardly tapered portion 46 of the liner.

Note that the section of the liner including the inwardly tapered portion 42, the reduced diameter portion 44, outwardly tapered portion 46 and collar 47 may be separately formed and welded to the liner at a location indicated at 63, for example. In order to tune the combustor with this arrangement, it is only necessary to drill additional cooling air entry holes in the sleeve 50 as needed, without also having to remove the transition piece. This is a tune-saving design.

In a variation of this design, a relatively tight fitting collar 51 could be applied over the sleeve 50, axially behind the seal 56. The collar 51 could have a series of circumferentially-spaced holes 59 in selected locations such that the collar could then be rotated to place some or all of the holes 59 into partial or full alignment with holes 58 to thereby achieve the desired cooling and tuning dilution characteristics without having to remove the transition piece and add holes to the sleeve 50.

Figure 4:
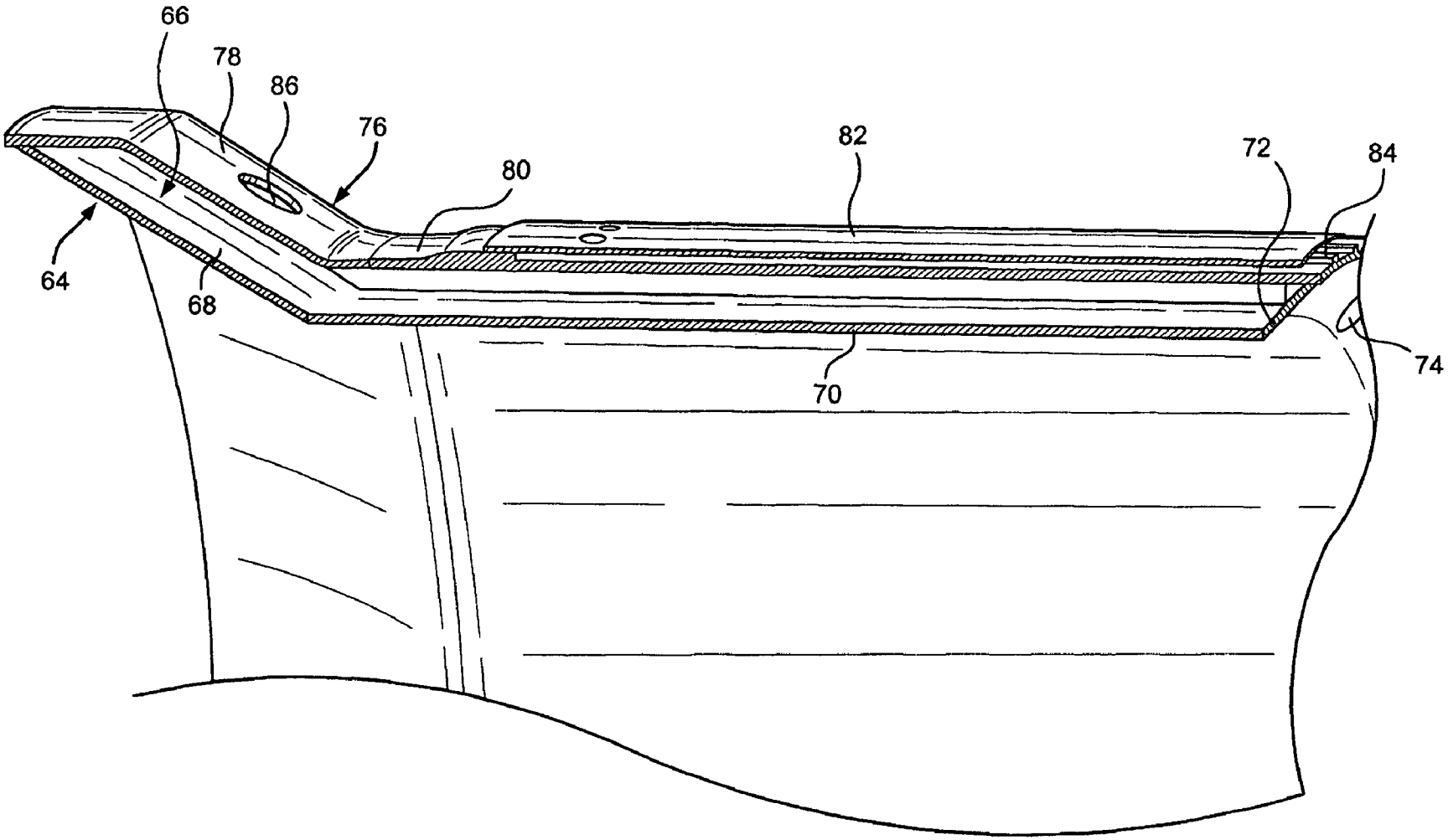
FIG. 4 is a partial section through the aft end of a combustor liner in accordance with a second exemplary but nonlimiting embodiment of the invention.

FIG. 4 illustrates another exemplary but nonlimiting embodiment of the invention. This embodiment represents a modification of the known configuration shown in FIG. 2. In this case, however, a new aft end piece 64 is added to the liner, and the original transition region (30 in FIG. 2) now serves as a cooling sleeve 76, establishing a plenum 66 therebetween. The aft end piece 64 is similar to the aft end in FIG. 3, with an inwardly tapered portion 68 leading to a reduced diameter portion 70. An outwardly tapered aft end portion 72 leads to a terminal collar and edge (not shown, but similar to FIG. 3). Cooling an exit holes 74 are formed in an annular array, about the tapered end portion 72. The cooling sleeve 76 also includes an inwardly tapered portion 78 leading to a reduced diameter portion 80 terminating at an aft end terminal edge (not shown). The cooling sleeve is similar to the sleeve shown in FIG. 2, but here, the channels are closed by eliminating the forward opening (36 in FIG. 2). In fact, the cover plate 82 and reduced diameter portion 80 could be made as a single piece, eliminating the channels 84.

Cooling air now enters the cooling air entry holes 86 formed about the tapered portion 78, flows through the plenum 66 and exits through cooling air exit holes 74 formed in the tapered aft end portion 72.

Figure 5:
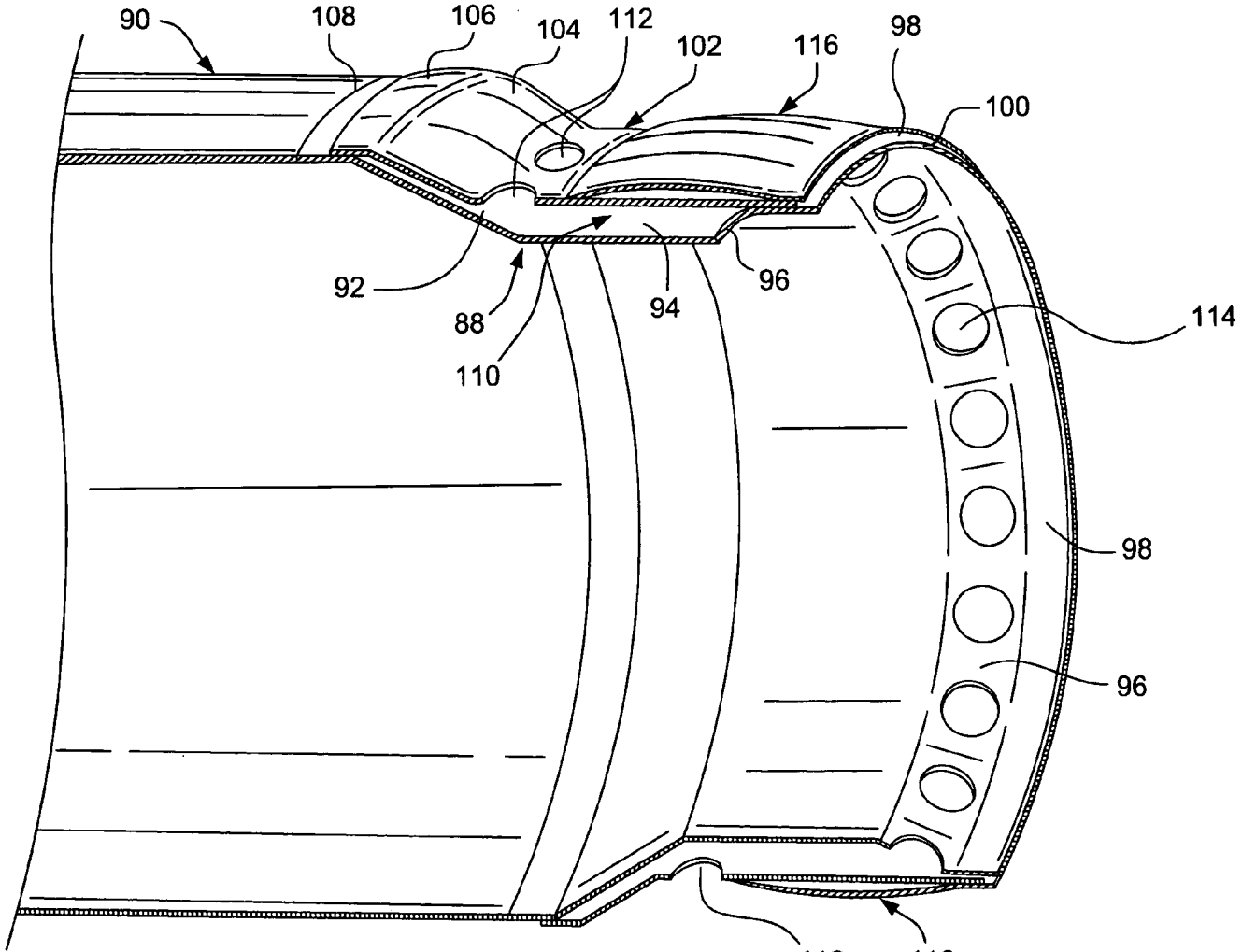
FIG. 5 is a partial section through the aft end of a combustor liner in accordance with a third exemplary but nonlimiting embodiment of the invention.

Turning now to FIG. 5, another exemplary and preferred embodiment of the invention is illustrated, which represents a simplified version of the cooling arrangement in FIG. 4. Specifically, the aft end piece 88 of the liner 90 is again formed with a inwardly tapered portion 92, a reduced diameter portion 94, an outwardly tapered aft end portion 96, and a flat terminal ring or collar 98 defining the aft edge 100 of the liner. A cooling sleeve 102 is welded to the ring or collar 98, of the liner, extending away from the terminal edge 100, and including a tapered portion 104 merging with a forward edge portion 106 where a slip joint is formed with the aft end piece 88, adjacent a forward edge 108 where the aft end piece 88 is joined to the liner 90. This arrangement creates a plenum 110 between the aft end piece 88 and the cooling sleeve 102. Cooling air entry holes 112 in the sleeve 102 permit cooling and dilution air to enter the plenum 110, and to exit via holes 114 formed in the outwardly tapered portion 96 of the aft end piece 88. A spring finger or hula seal 116 is welded to the aft end of the cooling sleeve 102.

The above-described cooling and dilution arrangements illustrated in FIGS. 3-5 dumps cooling air under the hula seal, cooling the seal along with the aft end of the combustor liner. At the same time, tuning of the combustor liner as it relates to the optimization of dilution air can be accomplished without having to remove the transition piece, by modifying or adding cooling air entry and/or end holes to the cooling sleeve and/or liner.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor liner comprising a forward end and an aft end, the aft end having a reduced diameter portion and a cooling and dilution sleeve overlying the reduced diameter portion thereby establishing a cooling plenum therebetween; a plurality of cooling and dilution air entry holes formed in said cooling sleeve and a plurality of cooling and dilution air exit holes formed in said combustor liner adjacent an aft edge of said combustor liner such that, in use, cooling air flows through said cooling and dilution air entry holes and through said plenum, exiting said plenum via said cooling and dilution air exit holes thereby cooling said aft end of said combustor liner.

2. The combustor liner of claim 1 wherein a compression seal is secured to an exterior surface of said cooling and dilution sleeve, directly radially outwardly of said plenum.

3. The combustor liner of claim 1 wherein said aft end includes an inwardly tapered portion leading to said reduced diameter portion, and an outwardly tapered portion leading to an annular collar, and further wherein a forward edge of said cooling and dilution sleeve engages said inwardly tapered portion and an aft edge of said cooling and dilution sleeve is secured to said collar.

4. The combustor liner of claim 1 wherein said aft end includes an inwardly tapered portion leading to said reduced diameter portion, and an outwardly tapered portion leading to an annular collar, and further wherein said cooling and dilution sleeve has a forward sleeve end engaged with the liner at a location upstream of said inwardly tapered portion and an aft sleeve end fixed to said collar.

5. The combustor liner of claim 3 wherein said cooling and dilution air entry holes are formed in an annular array adjacent said forward edge of said cooling and dilution sleeve.

6. The combustor liner of claim 5 wherein said cooling and dilution air exit holes are formed in an annular array in said outwardly tapered portion of said combustor liner.

7. The combustor liner of claim 4 wherein said cooling and dilution sleeve has an inwardly tapered portion proximate a forward edge thereof, and further wherein said cooling and dilution air entry holes are formed in an annular array in said inwardly tapered portion of said cooling and dilution sleeve, and said cooling and dilution air exit holes are formed in said outwardly tapered portion of said combustor liner.

8. The combustor of claim 7 wherein a compression seal is secured to an exterior surface of said cooling and dilution sleeve, directly radially outwardly of said plenum.

9. The combustor liner of claim 7 wherein said forward end of said cooling sleeve forms a slip joint with said combustor liner.

10. A combustor liner comprising a liner forward end and a liner aft end, the liner aft end having a reduced diameter portion and a cooling and dilution sleeve overlying the reduced diameter portion thereby establishing a cooling plenum therebetween; a plurality of cooling and dilution air entry holes formed in said cooling and dilution sleeve and a plurality of cooling and dilution air exit holes formed adjacent an aft liner edge such that, in use, cooling air flows through said cooling and dilution air entry holes, and through said plenum, exiting said cooling and dilution air exit holes thereby cooling said aft liner end;

wherein a compression seal is secured to an exterior surface of said cooling and dilution sleeve, directly radially outwardly of said plenum; and wherein said combustor liner aft end includes an inwardly tapered portion leading to said reduced diameter portion, and an outwardly tapered portion leading to an annular collar, said cooling and dilution sleeve having a forward sleeve end engaged with the liner at a location upstream of said inwardly tapered portion, and an aft sleeve end fixed to said collar.

11. The combustor liner of claim 10 wherein said cooling and dilution air exit holes are located in said outwardly tapered portion of said combustor liner.

12. The combustor liner of claim 10 wherein said cooling and dilution sleeve has an inwardly tapered portion proximate a forward edge thereof, and further wherein said cooling and dilution air entry holes are formed in an annular array in said inwardly tapered portion of said cooling and dilution sleeve, and said cooling and dilution air exit holes are formed in said outwardly tapered portion of said liner.

13. The combustor liner of claim 10 wherein said forward end of said cooling and dilution sleeve forms a slip joint with said combustor liner.

14. A method of cooling and dilution tuning an aft end of a combustor liner and associated annular seal comprising:

forming an aft end portion of the liner with a reduced diameter portion;

locating a cooling and dilution sleeve about said reduced diameter portion, in radially spaced relationship thereto so as to create an annular plenum;

forming cooling and dilution air entry holes in an upstream end of said cooling and dilution sleeve and cooling and dilution air exit holes in said combustor liner, proximate an aft edge thereof, such that, in use, cooling air flows through said cooling and dilution air entry holes into said plenum and through said cooling and dilution air exit holes.

15. The method of claim 14 wherein said cooling and dilution air entry holes are formed in an inwardly tapered transition region of said liner that leads to said reduced diameter portion.

16. The method of claim 15 wherein said cooling and dilution air exit holes are located in an outwardly tapered surface of said combustor liner, leading to said aft edge.

17. The method of claim 14 wherein a compression seal is supported on said cooling and dilution sleeve radially outwardly of said plenum.

18. The method of claim 14 including locating a rotatable collar in close-fitting relationship about a portion of said cooling and dilution sleeve said collar having holes therein that are selectively alignable with said cooling and dilution air entry holes to thereby achieve desired cooling and dilution tuning characteristics.

* * * * *